US011271341B2

(12) United States Patent
Riepe et al.

(10) Patent No.: US 11,271,341 B2
(45) Date of Patent: Mar. 8, 2022

(54) RETAINING FRAME

(71) Applicant: HARTING ELECTRIC GMBH & CO. KG, Espelkamp (DE)

(72) Inventors: Dieter Riepe, Luebbecke (DE); Alexej Beckstedt, Lotte-Wersen (DE)

(73) Assignee: HARTING ELECTRIC GMBH & CO. KG

( * ) Notice: Subject to any disclaimer, the term of this patent is extended or adjusted under 35 U.S.C. 154(b) by 0 days.

(21) Appl. No.: 17/052,493

(22) PCT Filed: Jun. 6, 2019

(86) PCT No.: PCT/DE2019/100516
§ 371 (c)(1),
(2) Date: Nov. 2, 2020

(87) PCT Pub. No.: WO2020/001685
PCT Pub. Date: Jan. 2, 2020

(65) Prior Publication Data

US 2021/0265765 A1 Aug. 26, 2021

(30) Foreign Application Priority Data

Jun. 27, 2018 (DE) ..... 10 2018 115 421.6

(51) Int. Cl.
*H01R 13/24* (2006.01)
*H01R 13/514* (2006.01)
(Continued)

(52) U.S. Cl.
CPC ..... *H01R 13/514* (2013.01); *H01R 13/518* (2013.01); *H01R 13/512* (2013.01)

(58) Field of Classification Search
CPC .. H01R 13/502; H01R 13/512; H01R 13/514; H01R 13/518
(Continued)

(56) References Cited

U.S. PATENT DOCUMENTS

| | | | | |
|---|---|---|---|---|
| 6,004,162 | A | 12/1999 | Harting et al. | 439/701 |
| 2017/0125936 | A1 | 5/2017 | Loetkemann et al. | H01R 13/514 |
| 2021/0265765 | A1* | 8/2021 | Riepe | H01R 13/518 |

FOREIGN PATENT DOCUMENTS

| | | | |
|---|---|---|---|
| DE | 10 2014 110 278 | 1/2016 | H01R 13/518 |
| EP | 0 860 906 | 5/2004 | H01R 13/518 |
| EP | 1 703 595 | 9/2006 | H01R 13/426 |

OTHER PUBLICATIONS

German Search Report issued in German Patent Appln. No. 10 2018 115 421.6, dated Sep. 16, 2020 with English translation, 8 pages.
(Continued)

*Primary Examiner* — Khiem M Nguyen
(74) *Attorney, Agent, or Firm* — Hayes Soloway P.C.

(57) ABSTRACT

A retaining frame for retaining plug-connector modules and/or plug connectors for installation in a plug connector housing, has two side parts each with at least one surface and at least one frame element designed to be fitted together to form the retaining frame. The surfaces of the side parts, once joined together, form a fastening surface having at least one recess for receiving a plug connector. The frame elements of the side parts of the retaining frame, once joined together, are spaced apart from one another and form at least one receiving region for receiving the plug-connector modules. On the fastening surface, at least one fixing element is provided, which can be fixed there in such a way that the side parts joined together to form the retaining frame are fixed, and that a plug connector accommodated in the recess is also axially fixed in the retaining frame.

20 Claims, 4 Drawing Sheets

Figures 1A, 1B, 1C:
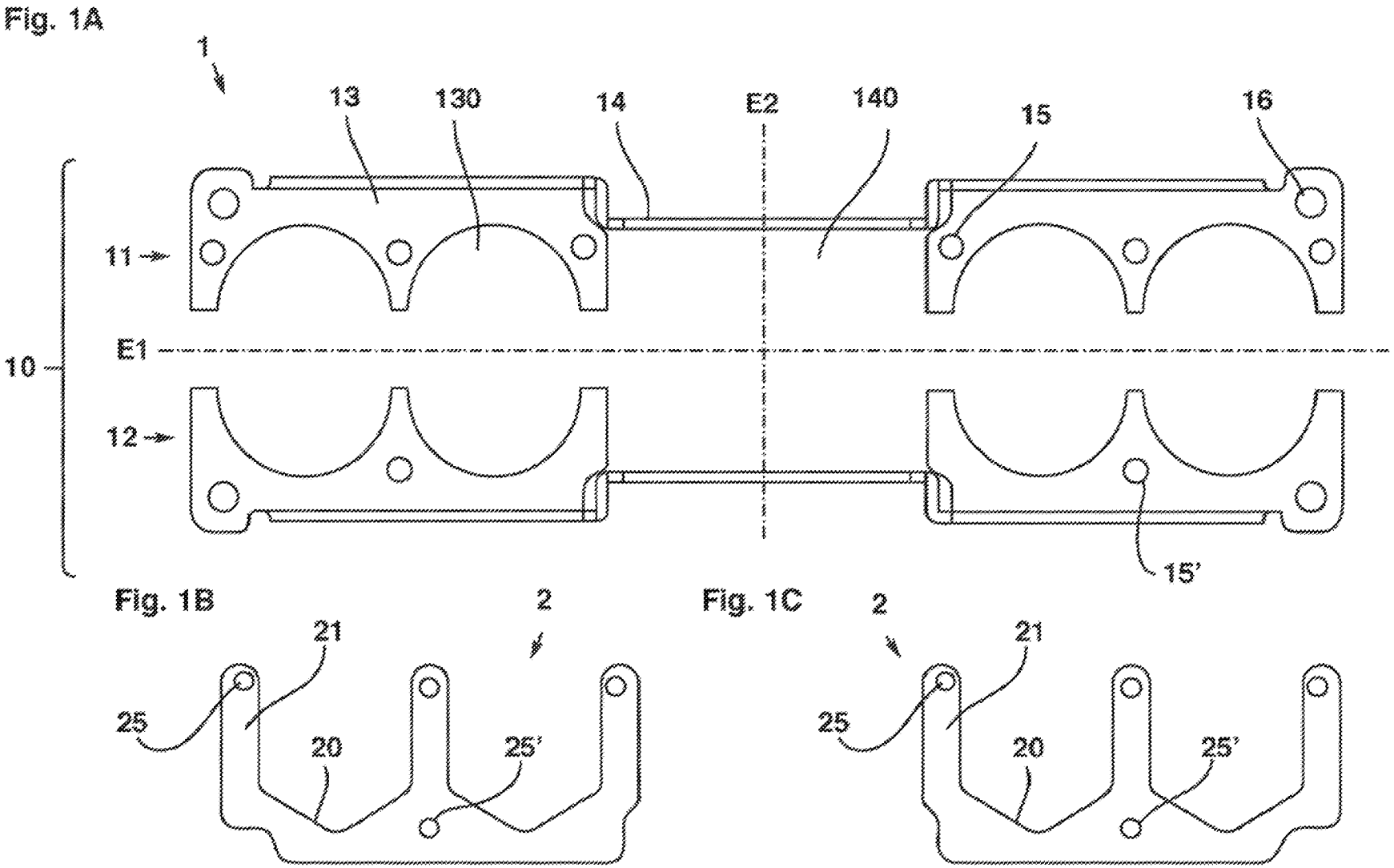

(51) Int. Cl.
*H01R 13/518* (2006.01)
*H01R 13/512* (2006.01)

(58) Field of Classification Search
USPC ..... 439/660, 701
See application file for complete search history.

(56) References Cited

OTHER PUBLICATIONS

International Search Report and Written Opinion issued in PCT/DE2019/100516, dated Sep. 16, 2019, with English translation, 18 pages.
International Preliminary Report on Patentability issued in PCT/DE2019/100516, dated Jan. 7, 2021, 8 pages.

* cited by examiner

RETAINING FRAME

The invention relates to a holding frame for plug-connector modules and/or for plug connectors.

Such holding frames are used to equip a so-called heavy plug connector with various plug-connector modules and various plug connectors. Plug-connector modules differ from plug connectors, in particular, in their design, and generally transmit control signals, while plug connectors generally transmit high currents (power connectors). In addition to the transmission of control signals, plug-connector modules may also be designed to transmit currents up to 200 A and voltages up to 1000 V.

PRIOR ART

A holding frame for plug-connector modules is known from EP 0 860 906 B1. The holding frame can be installed in a plug connector housing. The modules must all have the same so-called insertion path to the mating connector. This makes it difficult to integrate modules for high currents.

DE 10 2014 110 278 A1 attempts to counter this problem by providing a holding frame composed substantially of two angle plates and a module carrier. The angle plates are mirror-inverted relative to each other and, when assembled and screwed together, provide a fastening surface having receiving spaces for plug connectors, and having a further receiving space for the module carrier, which is designed to receive plug-connector modules.

The module carrier in this case is in turn screwed onto the fastening surface. In this way, the plug-connector modules and the plug connectors are mounted in different fastening planes, and compensation is provided for the so-called contact-area overlap, which can differ greatly for modules and plug connectors.

However, the production and assembly of a holding frame known from DE 10 2014 110 278 A1 with its elements to be screwed together in a protruding manner, in particular in different spatial directions, is disadvantageously complex.

In the priority application relating to the present application, the German Patent and Trade Mark Office has searched the following prior art: DE 10 2014 110 278 A1 and EP 0 860 906 B1.

Definition of Object

The object of the invention is therefore to propose a holding frame that is suitable for a plug connector, that can accommodate both plug connectors and plug-connector modules, and that, in particular, is easy to produce, equip and assemble.

The object is achieved with the features of claim 1.

Advantageous embodiments of the invention are indicated in the sub-claims and/or the description below.

The holding frame proposed here is equally suitable for holding plug-connector modules and holding entire plug connectors. It is also possible, however, that only modules or only plug connectors are held.

The holding frame may be integrated into a plug-connector housing. Normally the holding frame is screw-connected to the plug connector housing to ensure a stable connection of the two parts.

The present invention relates in particular to a holding frame for holding plug-connector modules and/or plug connectors for integration into a plug-connector housing, wherein the holding frame is realized substantially in two pieces.

The holding frame in this case has two side parts having at least one surface and at least one frame element, which can be assembled to form the holding frame. The side parts may be substantially identical and mirror-inverted relative to each other, which is also advantageous, in particular, for the production and/or assembly of the side parts.

The surfaces of the joined side parts of the holding frame form a fastening surface having at least one recess for receiving a plug connector; the side plates may expediently be composed of an angle plate. It is advantageous if the surfaces of the side parts in this case touch each other.

The frame elements of the joined side parts of the holding frame are spaced apart from each other and form at least one receiving region for receiving the plug-connector modules.

For production and/or assembly, in particular, it is advantageous if the surface of a side part is realized integrally with its frame element.

At least one fixing element having at least one fixing geometry is provided on the fastening surface, the fixing element being realized and fixable on the fastening surface in such a manner that the side parts joined together to form the holding frame are fixed to one another, and in addition a plug connector accommodated in the recess is axially fixed in the holding frame by means of the fixing element.

Accordingly, the above holding frame is advantageously made up substantially of only two elements, namely the two side parts, which are held together and fixed by means of a further element, namely the fixing element, which in addition fixes the plug connector axially. Accordingly, the fixing element has an advantageous double function.

The production of these few elements in this case is advantageously simple and cost-effective. This also applies to the assembly work involved in assembling and equipping the holding frame with plug connectors and/or plug-connector modules.

A fixing element of the above holding frame may expediently have at least one fixing geometry having a contour that corresponds in a form-fitting manner to a contour of a groove of an insulating body of the plug connector and accordingly acts in combination therewith.

Expediently, as an alternative or in addition to the above contour of the fixing geometry, two parallel fingers of the fixing element may extend in one direction, starting from the fixing geometry of the fixing element, wherein the fingers correspond in a form-fitting manner to the contour of the groove of the insulating body of the plug connector and accordingly act in combination therewith.

In this way, the plug connector can be fixed in a stable manner in the holding frame, in particular axially, in a simple and advantageously effective manner. In addition, the protruding contours may also be advantageously realized and act in combination with each other and/or with the fingers in such a manner that the plug connector is fixed in the holding frame so as to be secured against rotation.

In this way, however, the assembling of the holding frame, and in particular equipping it with a plug connector, also becomes particularly simple, and thus saves time and money.

This is because the above advantageous contour of the fixing geometry of the fixing element, which acts in combination with the groove, provides a rail-like guide for the plug connector.

In addition, this advantageously creates the possibility of providing a multiplicity of fixing elements having preassembled plug connectors for particularly simple assembly.

The fixing element may be screw-connected in an appropriate manner to at least one of the joined side parts of the holding frame. The fixing element in this case may be realized integrally with one of the side parts, and be screw-connected to the other side part. According a preferred embodiment, the fixing element may also be screw-connected to both side parts. An example of this embodiment is described below with reference to the drawings.

This not only provides a stable holding frame, but also creates a further possibility to enable the holding frame to be assembled in a particularly simple manner. This is because fixing element may be preassembled on one of the two side parts, after which only two elements are assembled to form the holding frame during final assembly, with simultaneous equipping of the holding frame.

Instead of screw-connection of the fixing element to firstly one of the side parts, the fixing element may also be realized integrally with one of the side parts, or the fixing element may be integrated into one of the side parts. This possibility may be provided, in particular, by means of a correspondingly increased thickness of the side part realized integrally with the fixing element.

If necessary, during mounting the holding frame in a plug-connector housing, a corresponding thickness compensation of the assembled side parts may be provided by means of suitable measures on the fastening means of the holding frame in the plug-connector housing and/or on the plug-connector housing.

The fixing geometry of the fixing element may expediently have the contour of, for example, a flat square or hexagonal open-end wrench.

According to an advantageous embodiment of the invention, the frame elements of the side parts of an assembled holding frame are arranged opposite each other, and may provide a frame of a receiving region for accommodating the plug-connector modules, such that a module carrier, advantageously integral with the side parts, is provided for the plug-connector modules.

This is advantageous because it eliminates the need for a further assembly step to fasten a module carrier on the fastening surface of the holding frame. A desirable fixing plane of the plug-connector modules to compensate their insertion paths to the plug connectors, the fastening plane of which may be determined, in particular, by the fixing surface, may be provided in a simple manner, in particular by means of a suitable height of the frame elements of the module carrier.

Expediently in this case, in order to provide the module carrier integral with the holding frame, realized in the frame elements are recesses that act in combination with latching elements of module housings of the plug-connector modules in such a manner that the plug-connector modules are fixed in the module carrier provided by the frame elements.

The holding frame, having the advantageous features described above, may expediently have two mutually spaced-apart regions of the fastening surface, having two central frame elements arranged opposite each other, such that two mutually spaced-apart regions are provided for receiving plug connectors, and a central region is provided for receiving plug-connector modules.

EXEMPLARY EMBODIMENT

Figure 2A:
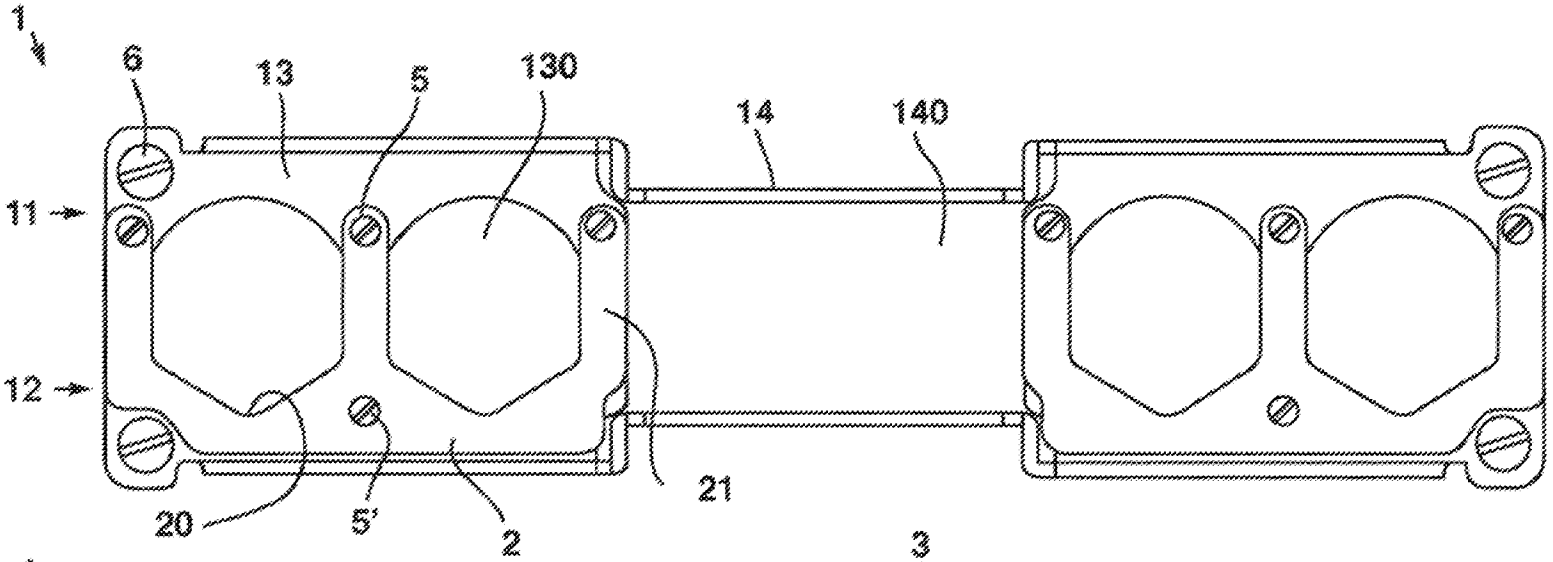
Figure 2B:
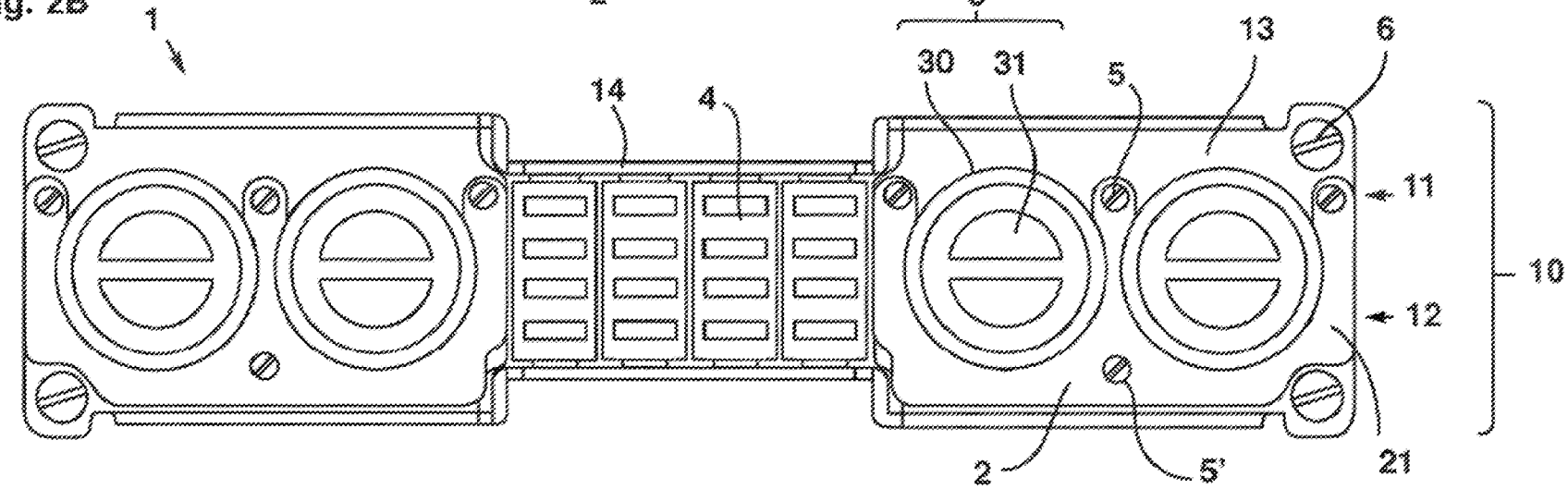
Figure 3B:
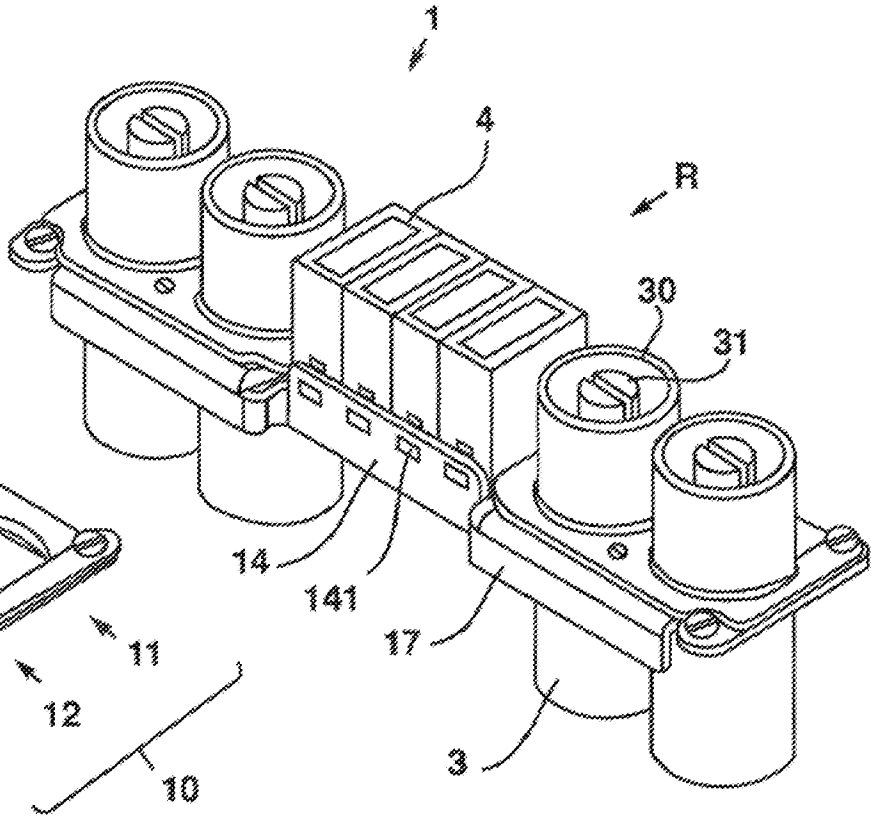
Figure 3A:
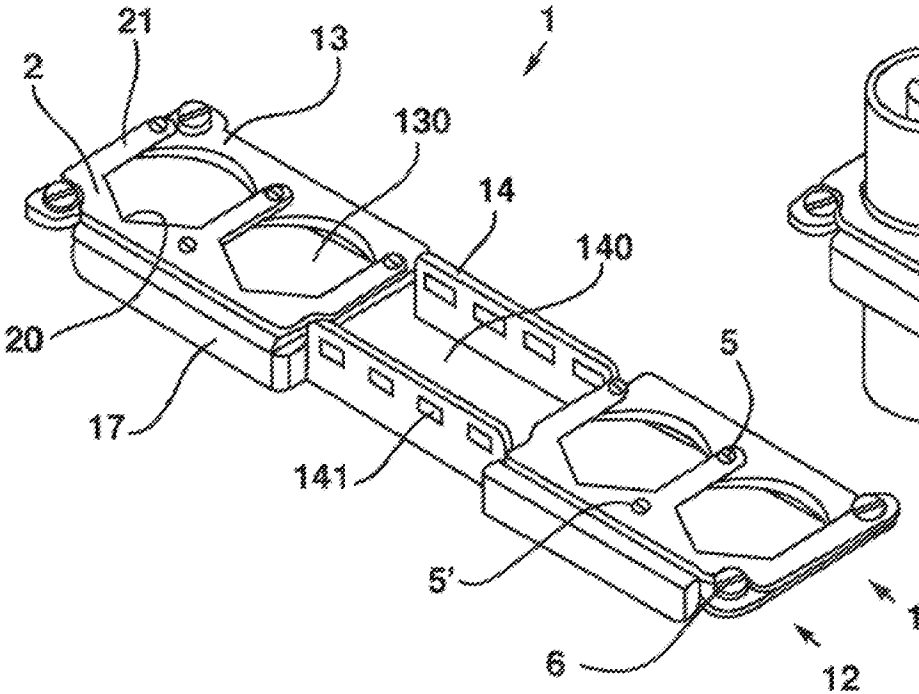
Figure 4A:
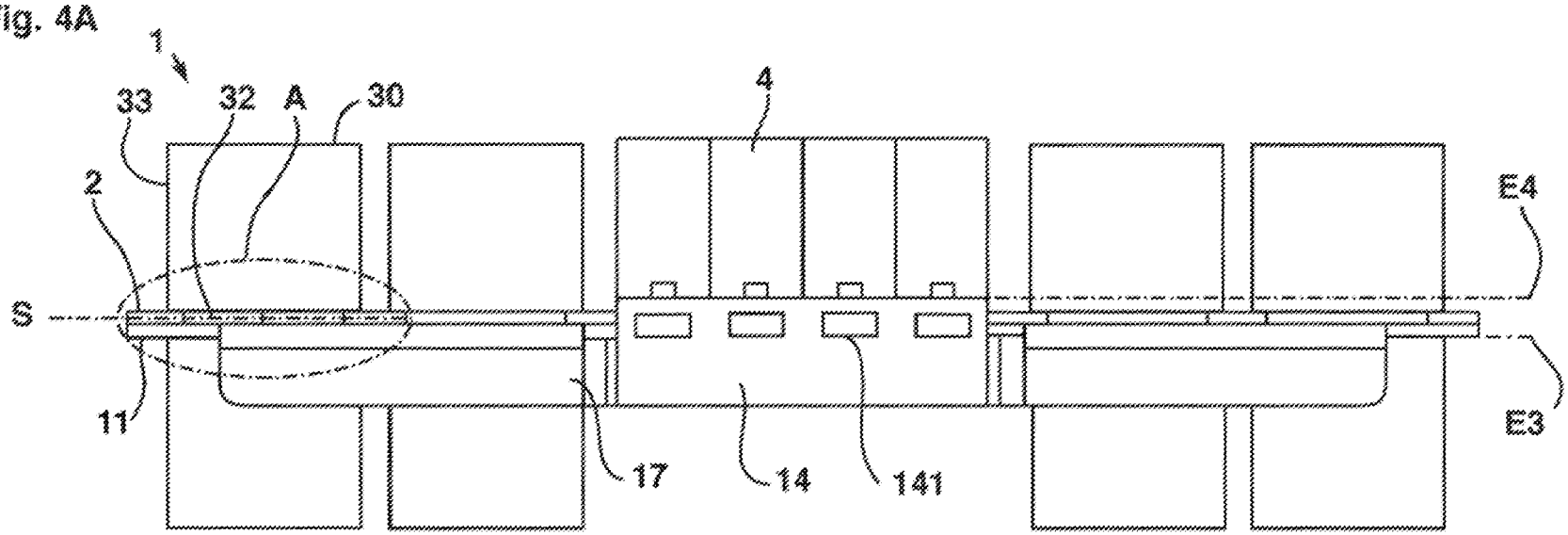
Figure 4C:
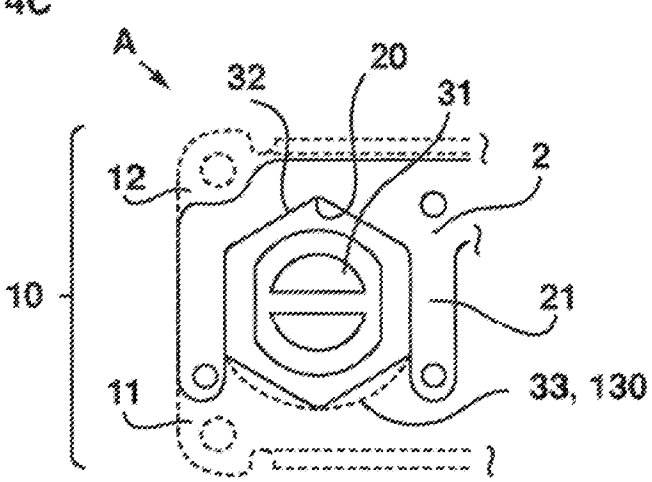
Figure 4B:
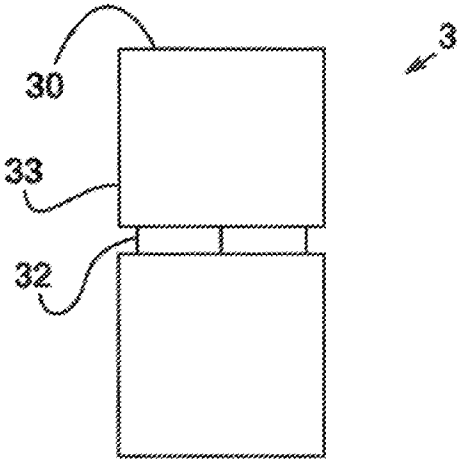

An exemplary embodiment of the invention is represented in the drawings and explained in greater detail in the following. There are shown:

FIG. 1A a top view of two opposite side parts of a holding frame, spaced apart from each other, according to an embodiment of the invention;

FIG. 1B a top view of a fixing element for fixing two side parts of FIG. 1A, assembled to form a holding frame;

FIG. 1C the fixing element of FIG. 1C, from the other side;

FIG. 2A the side parts of the holding frame of FIG. 1A, assembled and fixed with the fixing element of FIG. 1B;

FIG. 2B the holding frame of FIG. 2A, with plug connectors und plug-connector modules held in the holding frame;

FIG. 3A a perspective representation of the holding frame of FIG. 2A;

FIG. 3B a perspective representation of the holding frame of FIG. 2B;

FIG. 4A a side view of the holding frame of FIG. 2B and FIG. 3B, from the direction R of FIG. 3B;

FIG. 4B an insulating body of a plug connector of FIG. 4A; and

FIG. 4C a partial section of the holding frame of FIG. 4A.

The figures contain partly simplified, schematic representations. In some cases, elements that are alike, but possibly not identical, are denoted by identical references. Differing views of identical elements could differ in scale.

FIG. 1A shows a top view of two opposing side parts 11 and 12 of a holding frame 1 according to an embodiment of the invention, which are slightly spaced apart from each other. By way of introduction it may be stated here in connection with FIG. 1A, and also representatively in connection with the other drawings, that in the drawings, for the sake of simplicity and clarity, for each identical, or similar element, of holding frame 1, only one of the identical elements is denoted by a reference. For example, the side part 11 and 12 of the holding frame 1 of FIG. 1A together have four identical drill-holes 16, but in the drawing only one of the drill-holes 16 is denoted by a reference.

The two side parts 11, 12 are realized substantially symmetrically and integrally, both in relation to each other and in themselves. In this regard see the mirror planes E1 and E2 in FIG. 1A. Extending at the two ends of a central frame element 14 there are angle plates, each realized symmetrically in relation to E2, having a surface 13 and a side wall 17 that is angled away from the surface 13. The angled side wall 17 provided, in particular, the stability/stiffness of holding frame 1 and is most clearly shown in FIGS. 3A and B.

Only the arrangement of the drill-holes 15 and 15' in the surfaces 13 and the realization of recesses 141 in frame elements 14, described below with reference to FIGS. 3A and 3B, is excluded from the substantially symmetrical realization of the two opposite side parts with respect to E1.

The surfaces 13 of the side parts 11, 12, which are assembled as intended at E1 in the drawing, touch each other, and with their surfaces 13 form two regions of a fastening surface 10 of holding frame 1 that are spaced apart from each other. Located between the two surfaces 13 is the receiving region 140, which is delimited by the two opposing frame elements 14, and which interrupts the fastening surface 10.

The side parts 11, 12 are realized in such a manner that four circular recesses 130 are provided in the fastening surface 10 of the assembled holding frame 1 of FIG. 1A, each forming a receiving region 130 for a plug connector 3. The two central frame elements 14 delimit the central receiving region 140, which is suitable for receiving plug-connector modules 4, in particular for signal contacts. As stated above, realized in the opposing frame elements 14 there are recesses 141 that act in combination with latching elements of the plug-connector modules 4, as described below with reference to FIGS. 3A and 3B. In this way, the frame elements 14 form a module carrier, realized integrally with the side parts 11, 12, for receiving plug-connector modules 4.

FIG. 1B shows a fixing element 2 for fixing the side parts 11, 12 of FIG. 1A, which are assembled at E1 at their contacting surfaces 13 to form a holding frame 1. The fixing element 2, like the holding frame 1, is likewise expediently prepared from a metal sheet in which drill-holes 25 and 25' are provided, which correspond respectively to the drill-holes 15 and 15' of the fixing surface 10.

Starting from a fixing geometry 20 of the fixing element 2, parallel fingers 21 extend in one direction, such that the fixing geometry 20 is clear in one direction and an open-end wrench-like contour is provided. It is clear that the fixing element 2 of this embodiment of the invention is designed with three fingers 21 and two fixing geometries 20, corresponding to the number of recesses 130 of the fastening surface 10, and on the fastening surface 10 of FIG. 1A two fixing elements 2, turned accordingly, are provided. FIG. 1C shows for this an accordingly turned fixing element 2 from FIG. 1B.

The fixing geometry 20 and respectively two opposing fingers 21 of the fixing element 2 are realized to correspond to a recess 130 of the holding frame 1 in such a manner that, when the fixing element 2 is arranged as intended on the fastening surface 10 of the holding frame 1 with congruent correspondence of the position of the drill-holes 15 and 25, or 15' and 25', the fixing geometry 20 and the two fingers 21 cover predetermined portions of the recess 130.

This arrangement of the assembled holding frame 1 of FIG. 1A, with the two fixing elements 2 of FIG. 1B and FIG. 1C, is shown in a top view of holding frame 1 of FIG. 2A and in a perspective representation of FIG. 3A.

In the case of this embodiment, which is described with reference to the drawings, the fixing element 2 is realized in such a manner that, for its intended function, it is screw-connected to the two side parts 11, 12. In the case of this embodiment, the side parts 11, 12 and the fixing element 2 can be produced particularly easily and inexpensively.

According to an embodiment not represented in the drawings, at least one of the fixing elements 2 may also be realized integrally with the side part 12, in which case the respective drill-holes 15' and 25' are omitted. This alternative embodiment is advantageous for particularly simple assembly of holding frame 1. In this regard, reference is made in particular to the following description with reference to FIGS. 3A and 3B.

The side parts 11, 12 of the holding frames 1 represented in FIGS. 2A and 3A are fixed by means of two fixing elements 2. For this purpose screws 5 are provided for the drill-holes 15 and 25. The drill-holes 15, 15' and 25, 25' may be threaded drill-holes or also simple holes. The fixing elements 2 are fixed on the fastening surface 10 of the holding frame 1 by means of screws 5, 5', and in turn thereby fix the side parts 11, 12.

The screws 5, 5', and 6, in this case correspond respectively to the drill-holes 15, 25 and 15', 25', and 16, of the fastening surface 10 and of the fixing element 2. In the case of this embodiment, as represented in the drawing, the screws 5, 5' are expediently screw-connected to the holding frame 1 from above in the same direction as the other screws 6. Clearly, the screws 5, 5' may also be screw-connected to the holding frame 1 from below.

In case of an advantageous and simple assembly of the holding frame 1, at least one fixing element 2 is first fixed with a screw 5 on the side part 12 as intended, and then the two side parts 11, 12 are joined together. This is advantageous, in particular, in the case of the holding frame 1 being assembled and simultaneously equipped with plug connectors 3 and/or plug-connector modules 4 in substantially one step, which is described below with reference to FIG. 3B.

The screws 6 corresponding to the drill-holes 16 are intended for mounting and fastening the holding frame 1 in a plug-connector housing not shown in the drawings. The drill-holes 16 may also be designed as threaded drill-holes or as simple through-holes.

FIG. 2B shows holding frame 1 of FIG. 2A with plug connectors 3 and plug-connector modules 4 held in holding frame 1. The holding frame 1 in this case is fully equipped according to its design with the, for example, four recesses 130 and the dimensioning of the receiving region 140. The module carrier described briefly above in FIG. 1A, provided by means of the opposing frame elements 14, houses four plug-connector modules 4, with corresponding latching elements of the module housings being latched to the recesses 141 of the frame elements 14. In this regard see also FIGS. 3A and 3B and the corresponding description.

The plug connectors 3 arranged in the recesses 130 are designed as heavy-duty plug connectors for high-current contacts having the contacts 31, which are housed in a cylindrical insulating body 30 and insulated accordingly. The dimensions of the insulating bodies 30 correspond to the dimensions of the circular recesses 130 in such a manner that the diameter of an insulating body 30 corresponds approximately to the diameter of a recess 130.

Accordingly, the circumferential periphery 33 of the insulating body 30, as is most clearly visible in the representation of FIG. 2B, also covers a region of respectively two fingers 21 and the fixing geometry 20 of a fixing element 2 that is assigned to the fingers 21, which in turn cover corresponding regions of a recess 130 assigned to them, as described above with reference to FIG. 2A. The possibility of this arrangement is created by the fact that the circumferential periphery 33 of a cylindrical insulating body 30 has a groove 32, the dimensions and contour of which correspond in a form-fitting manner to the dimensions and contour of the fixing geometry 20 of the fixing element 2.

With regard to the above form-fitting combined action of the contours of the groove 32 of the insulating body 30 and the fixing geometry 20 of the fixing element 2, reference is also made here in particular to the drawings FIGS. 4A to 4C and the description thereof.

The height, or thickness, of the fixing element 2 corresponds in this case in a form-fitting manner to the height, or thickness, of the groove 32 of the insulating body 30, and the contour of the groove 32 corresponds in a form-fitting manner to the contour of the fixing geometry 20 and the distance between two fingers 21 of the fixing element 2 that are assigned to the fixing geometry 20. In this embodiment, the contour of the groove 32 of the insulating body 30 is expediently and exemplarily realized as a hexagon, which corresponds to the hexagon contour, open to one side, that is provided by a fixing geometry 20 and the two fingers 21 assigned to it.

In other words, two opposing and parallel fingers 21, with their associated fixing geometry 20, have the contour of a hexagonal open-end wrench, which acts in combination with a corresponding hexagonal nut realized in the groove 32 of the insulating body 30 described above and which is stepped inwards from the outer edge of the insulating body 30. This also ensures that the insulating body 30 is secured against rotation.

A plug connector 3 held in a holding frame 1 of the invention, together with an insulating body 30 as described above, therefore initially lies with the periphery 33 of its insulating body 30 in a form-fitting manner against the periphery of the recess 130 of the fastening surface 10. In addition, the open-end wrench-like contour of the fingers 21 and of the fixing geometry 20 of the fixing element 2 arranged on the fastening surface 10 is arranged in a form-fitting manner in the groove 32 of the insulating body 30. In this way, the plug connector 3 is fixed in an axially stable manner in the holding frame 1. It is clear that, instead of a hexagonal contour, the fixing geometry 20 with its fingers 21 may also have a square contour or other contour that allows a rail-like insertion of the insulating body 30 into the fixing element 2, which is described below with reference to FIG. 3B.

Since, on the one hand, the fixing element 2 fixes the side parts 11, 12 of the holding frame, and also additionally fixes the plug connector 3 axially and non-rotatably in the holding frame, the fixing element 2 has a corresponding advantageous double function.

FIGS. 3A and 3B each show a perspective representation of the unequipped holding frame 1 of FIG. 2A, and of the holding frame 1 of FIG. 2B equipped with the plug-connector modules 4 and the plug connectors 3.

The fastening surface 10 of side parts 11 and 12, which are realized as angle plates, is angled at its outer peripheries, thus providing side walls 17 of the holding frame 1, which stabilize the holding frame 1 and give it a predetermined rigidity. The opposing frame elements 14 each adjoin the side walls 17 and form the frame of receiving region 140, whereupon a module carrier is provided to accommodate the plug-connector modules 4. Realized in the frame elements 14 in this case are corresponding recesses 141, which correspond to latching elements of the module housings of the plug-connector modules 4 in such a manner that plug-connector modules 4 inserted in the holding frame 1 are immovably accommodated in the module carrier.

The frame elements 14 of the module carrier are advantageously realized integrally with the respective side parts 11, 12, whereupon a holding frame 1 according to the invention can be produced in a simple and cost-effective manner.

It is clear that the dimensioning and positioning of frame elements 14 is designed to match the dimensions of plug-connector modules 4 intended to accommodate them. It is also clear that the dimensions of the surfaces 13 with their recesses 130 are also designed to match the dimensions of the plug-connector modules 3 intended for them. In the case of the embodiment described here, the frame elements 14 in this case are accordingly stepped inward relative to the side walls 17.

As with the stepping described above, the fastening plane E4 of the plug-connector modules 4 can also be easily optimized to the dimensions of the plug-connector modules 4, in particular also in relation to the dimensions of the plug connectors 3, in that a corresponding height of the frame elements 14 and their recesses 141 is provided. In this way, the plug connectors 3 and the plug-connector modules 4 can be mounted and fastened in different fastening planes E3 and E4. This is desirable, in particular, in order to largely compensate their contact-area overlap, which, as mentioned at the beginning, can differ greatly for the plug-connector modules 4 and the plug connectors 3.

The fastening plane E3 of plug connector 3 is determined in this case by the fastening surface 10. In addition, a desirable fastening position of a plug connector 3 may also be determined by the position of the groove 32 in its insulating body 30. Reference is also made in this regard to FIG. 4A and to the description relating thereto.

In the case of an advantageously simple assembly of holding frame 1, the plug connectors 3, in order to be accommodated as intended, are positioned between the side parts 11 and 12, in which case at least one fixing element 2 may already be expediently fastened, or pre-assembled, on the surface 13 of the side part 12, which is intended for the fixing geometry 20 of the fixing element 2. The two side parts 11, 12 are then joined together as intended and the fixing elements 2 in this case are inserted with their fingers 21 and their fixing geometries 20 laterally into the groove of the insulating bodies 30 of the plug connectors 3. Finally, the fixing elements 2 are also screw-connected to the side part 11 and in this way the side parts 11, 12 are fixed to each other, such that an assembled holding frame 1 is provided and, in addition, the plug connectors 3 are arranged axially in the holding frame 1 in one work step, and fixed axially and so as to be secure against rotation.

Depending on the nature of the latching elements of the module housings of the plug-connector modules 4, the plug-connector modules 4 may be inserted into a holding frame 1, as described and assembled above, from above into the module carrier provided for them, such that the latching elements latch with the recesses 141 of the frame elements 14 of the module carrier and the plug-connector modules 4 are fastened. This is the case with suitable elastic latching elements that have spring properties. In case of latching elements having other properties, the plug-connector modules 4 may be positioned and accommodated as intended in a manner similar to that of the plug connector 3, as described above in the case of joining of the side parts 11, 12.

Alternatively and equally advantageously, a fixing element 2 may first be inserted into the groove of an insulating body 30, in which case the fixing element 2 may likewise be pre-assembled on the side part 12, in order then to be joined to the side part 11 to form a holding frame 1 for final assembly. The periphery of the recess 130 of the side part 11 is in contact only with the circumferential periphery 33 of the insulating body 30, and can also be joined axially from below to the side part 12 and to the plug connector 3 preassembled in this manner. The above advantageous assembly method is particularly suitable, in particular, for the above mentioned alternative embodiment of the invention having an integrally realized side part 12 and fixing element 2.

In other words, fixing elements 2 and/or plug connectors 3 and/or side parts 12 may each be preassembled with each other for a desirable simple and inexpensive assembly.

The advantageous assembly of a holding frame 1 as described above, including the embodiment described here with reference to the drawings, is illustrated in particular by an overview of FIGS. 1A and B and FIGS. 3A and 3B.

In the case of the embodiment of the plug connector 3 of FIG. 3B, a bead is additionally provided above the groove 32 of its insulating body 30 that corresponds to the fixing element 2.

FIG. 4A shows a side view of holding frame 1 of FIG. 3B from the direction R of FIG. 3B, FIG. 4B shows one of the insulating bodies 30 of the plug connectors 3 of holding frame 1 of FIG. 4A, and FIG. 4C shows a partial section of the holding frame 1 of FIG. 4A through the portion A along the line S of FIG. 4A.

For the sake of simplicity and clarity, the bead of the insulating body 30 above the groove 32, and of the screws 5 and 6, have not been represented here.

The side part 11 of holding frame 1 of FIG. 4A is facing the direction of view, and the opposite side part 12 is facing away from the direction of view and cannot be seen. Like the modules 4 of FIG. 3B, the modules 4 also are not fully inserted into the intended module carrier, in order to illustrate by means of the drawing their elements intended to latch with the recesses 141 of the frame element 14.

The plane E4 denotes the fastening plane E4 for fastening the plug-connector modules 4, and is spaced apart from the fastening plane E3 for fastening the plug connectors 3, such that a desirable compensation of the insertion path of the plug-connector modules 4 and plug connectors 3 is provided. The fastening plane E4 is determined by the height of the frame elements 14 and/or the arrangement of the recesses 141, and the fastening plane E3 is determined by the fastening surface 10 and/or the position of the groove 32 in the insulating body 30.

The partial section through the portion A of FIG. 4A along line S goes through the fixing element 2 with its fixing geometry 20 and fingers 21 and through the plug connector 3 with its insulating body 30, groove 32 and contact element 31. The elements of the section are represented in FIG. 4C by solid lines, while the non-section elements, namely the side part 11 and 12, are represented in FIG. 4C as dashed lines. The dashed lines in this case denote a corresponding section through the fastening surface 10 in which the periphery 33 of the insulating body 30 is in contact with the periphery of the recess 130.

As already stated above, the groove 32 of the embodiment described here has a hexagonal geometry, which acts in combination with the geometry of the fixing element 2. The insulating body 30 in this case has two opposing flat portions on the inside, in particular in the region of its outer groove 32, to increase its wall thickness for a desirable stability. It is clear that the insulating body 30 of the plug connector 3 is cylindrical on both the outside and inside in the region of its insertion path.

Even if different aspects or features of the invention are in each case shown in combination in the figures, it is obvious to persons skilled in the art—unless otherwise indicated—that the combinations represented and discussed are not the only possible combinations. In particular, mutually corresponding units or complexes of features from differing exemplary embodiments may be interchanged.

LIST OF REFERENCES

1 holding frame
10 contact face, fastening surface
11, 12 side part, angle plate
13 surface
130 receiver, recess
14 frame element
140 receiving region
15, 15' drill-hole
16 drill-hole
17 side wall
2 fixing element, fixing plate
20 fixing geometry, holding geometry
21 finger
25, 25' drill-hole
3 plug connector
30 insulating body
31 contact element
32 groove
33 periphery
4 plug-connector module
5, 5' screw
6 screw
E1, E2 plane, mirror plane
E3, E4 plane, fastening plane
A portion
R direction
S line

The invention claimed is:

1. A holding frame for holding plug-connector modules and/or plug connectors for integration into a plug-connector housing, wherein the holding frame is realized substantially in two pieces, having the features:

two side parts having at least one surface and at least one frame element are configured such that they can be assembled to form the holding frame;

the surfaces of the joined side parts form a fastening surface having at least one recess for receiving a plug connector;

the frame elements of the joined side parts of the holding frame are spaced apart from each other and form at least one receiving region for receiving the plug-connector modules;

at least one fixing element having at least one fixing geometry is provided on the fastening surface, which fixing element is configured to be fixable on the fastening surface in such a manner that the side parts joined together to form the holding frame are fixed to one another, and in addition a plug connector accommodated in a recess is axially fixed in the holding frame.

2. The holding frame as claimed in claim 1, wherein:

the side parts are substantially alike and are configured to be assembled in mirror symmetry in relation to each other to form the holding frame; and the side parts are each composed of an angle plate having at least one surface, wherein the surfaces of the joined side parts touch each other, and the frame element of a side part is formed integrally with the surface thereof.

3. The holding frame as claimed in claim 1, wherein the fixing element is configured such that a plug connector arranged in a recess is secured against rotation.

4. The holding frame as claimed in claim 1, wherein the fixing element has at least one fixing geometry having a contour that corresponds in a form-fitting manner to a contour of a groove of an insulating body of a plug connector and accordingly acts in combination therewith.

5. The holding frame as claimed in claim 1, wherein:

two parallel fingers extend in one direction, starting from the fixing geometry of the fixing element, wherein the fingers correspond in a form-fitting manner to a contour of a groove of an insulating body of a plug connector and accordingly act in combination therewith.

6. The holding frame as claimed in claim 1, wherein the fixing element is screw-connected to at least one of the joined side parts of the holding frame.

7. The holding frame as claimed in claim 1, wherein the fixing element is formed integrally with one of the side parts.

8. The holding frame as claimed in claim 1, wherein the fixing geometry of the fixing element has the contour of a flat hexagonal open-end wrench.

9. The holding frame as claimed in claim 1, wherein the recess corresponds in a form-fitting manner to an outer circumferential periphery of the plug connector, and the fixing geometry of the mounted fixing element covers a part of the recess.

10. The holding frame as claimed in claim 1, wherein the frame elements of the side parts of the joined holding frame are arranged opposite each other, and form a frame of the receiving region for accommodating the plug-connector modules, such that a module carrier, integral with the side parts, is provided for the plug-connector modules.

11. The holding frame as claimed in claim 1, wherein formed in the frame elements are recesses configured to act in combination with latching elements of module housings of the plug-connector modules.

12. The holding frame as claimed in claim 1, having two mutually spaced-apart surfaces of the fastening surface, and having two central frame elements arranged opposite each other, such that two mutually spaced-apart regions are provided for receiving plug connectors, and a central region is provided for receiving plug-connector modules.

13. The holding frame as claimed in claim 1, having four recesses for receiving plug connectors.

14. The holding frame as claimed in claim 1, wherein the fixing element has at least one fixing geometry having a contour that corresponds in a form-fitting manner to a contour of a groove of an insulating body of a plug connector and accordingly acts in combination therewith, and wherein:

two parallel fingers extend in one direction, starting from the fixing geometry of the fixing element, wherein the fingers correspond in a form-fitting manner to a contour of a groove of an insulating body of a plug connector and accordingly act in combination therewith.

15. The holding frame as claimed in claim 2, wherein the fixing element is configured such that a plug connector arranged in a recess is secured against rotation.

16. The holding frame as claimed in claim 2, wherein the fixing element has at least one fixing geometry having a contour that corresponds in a form-fitting manner to a contour of a groove of an insulating body of a plug connector and accordingly acts in combination therewith.

17. The holding frame as claimed in claim 2, wherein:

two parallel fingers extend in one direction, starting from the fixing geometry of the fixing element, wherein the fingers correspond in a form-fitting manner to a contour of a groove of an insulating body of a plug connector and accordingly act in combination therewith.

18. The holding frame as claimed in claim 3, wherein the fixing element has at least one fixing geometry having a contour that corresponds in a form-fitting manner to a contour of a groove of an insulating body of a plug connector and accordingly acts in combination therewith.

19. The holding frame as claimed in claim 3, wherein:

two parallel fingers extend in one direction, starting from the fixing geometry of the fixing element, wherein the fingers correspond in a form-fitting manner to a contour of a groove of an insulating body of a plug connector and accordingly act in combination therewith.

20. The holding frame as claimed in claim 2, wherein the fixing element has at least one fixing geometry having a contour that corresponds in a form-fitting manner to a contour of a groove of an insulating body of a plug connector and accordingly acts in combination therewith, and wherein:

two parallel fingers extend in one direction, starting from the fixing geometry of the fixing element, wherein the fingers correspond in a form-fitting manner to a contour of a groove of an insulating body of a plug connector and accordingly act in combination therewith.

* * * * *